US009551529B2

(12) United States Patent
Freers et al.

(10) Patent No.: US 9,551,529 B2
(45) **Date of Patent: *Jan. 24, 2017**

(54) AIR DELIVERY APPARATUS WITH INTERCHANGEABLE NOZZLE INSERTS

(71) Applicant: MAXUM LLC, Rochester Hills, MI (US)

(72) Inventors: James L. Freers, Rochester Hills, MI (US); James M. Pankey, Rochester, MI (US)

(73) Assignee: MAXUM LLC, Rochester Hills, MI (US)

( * ) Notice: Subject to any disclaimer, the term of this patent is extended or adjusted under 35 U.S.C. 154(b) by 216 days.

This patent is subject to a terminal disclaimer.

(21) Appl. No.: 14/334,914

(22) Filed: Jul. 18, 2014

(65) Prior Publication Data

US 2014/0339322 A1 Nov. 20, 2014

Related U.S. Application Data

(63) Continuation of application No. 13/066,933, filed on Apr. 28, 2011, now Pat. No. 8,814,067.

(51) Int. Cl.

| | |
|---|---|
| ***B05C 11/06*** | (2006.01) |
| ***F26B 21/00*** | (2006.01) |
| ***B05C 11/02*** | (2006.01) |
| ***F24F 13/065*** | (2006.01) |
| *B05B 1/04* | (2006.01) |

(52) U.S. Cl.

CPC ..... *F26B 21/004* (2013.01); *B05B 1/044* (2013.01); *B05C 11/02* (2013.01); *B05C 11/06* (2013.01); *F24F 13/065* (2013.01); *B05B 1/04* (2013.01); *B05B 1/046* (2013.01); *B05B 1/048* (2013.01); *Y10T 137/85978* (2015.04)

(58) Field of Classification Search

CPC ..... B05B 1/04; B05B 1/044; B05B 1/046; B05B 1/048; F26B 21/004; B05C 11/06

See application file for complete search history.

(56) References Cited

U.S. PATENT DOCUMENTS

| | | | |
|---|---|---|---|
| 2,976,794 | A | 3/1961 | Allander et al. |
| 4,515,313 | A | 5/1985 | Cavanagh |
| 4,524,716 | A | 6/1985 | Mueller |
| 4,893,752 | A | 1/1990 | Spink et al. |
| 5,064,118 | A | 11/1991 | Lauricella |
| 5,221,345 | A | 6/1993 | Blankenship et al. |
| 5,683,514 | A | 11/1997 | Cox et al. |
| 6,990,751 | B2 | 1/2006 | Riley et al. |
| 7,563,322 | B2 | 7/2009 | Loth |
| 2010/0163653 | A1 | 7/2010 | Pucciani |

FOREIGN PATENT DOCUMENTS

| | | | |
|---|---|---|---|
| KR | 20070106266 | A | 11/2007 |

*Primary Examiner* — Arthur O Hall
*Assistant Examiner* — Alexander Valvis
(74) *Attorney, Agent, or Firm* — John A. Miller; Michael D. Marra; Miller IP Group, PLC

(57) ABSTRACT

An apparatus that uses an optimized body design incorporating one or more interchangeable nozzle inserts with a wide array of discharge orifice sizes, configurations and spacings to efficiently and effectively deliver a pressurized, high velocity, laminar flow air stream to dry, cool, or clean objects that are either stationary or moving transversely through the optimized air stream developed by the apparatus, all while minimizing the operational downtime required to implement the interchangeable nozzle insert modifications to the apparatus.

14 Claims, 3 Drawing Sheets

AIR DELIVERY APPARATUS WITH INTERCHANGEABLE NOZZLE INSERTS

CROSS-REFERENCE TO RELATED APPLICATIONS

This application is a continuation application of U.S. patent application Ser. No. 13/066,933, titled OPTIMIZED AIR DELIVERY APPARATUS, filed Apr. 28, 2011.

TECHNICAL FIELD

This disclosure is directed to an apparatus that employs a body design incorporating one or more customized interchangeable nozzle inserts to efficiently and effectively optimize and deliver a pressurized air stream to dry, cool, or clean objects that are either stationary or moving transversely through the optimized air stream developed by the apparatus.

BACKGROUND

Air knives are known for directing elongated air curtains for various purposes such as drying, cooling, or cleaning objects placed in stationary opposition to, or conveyed transversely through, the air curtain. To supply air to the air knife, it is most typical and economical to use pressure blowers compared to air compressors that require significantly more energy to operate. The most commonly used air knife designs incorporate hollow tubes of various lengths and diameters, with air introduction at either one end, both ends, or the midpoint of the air knife Air knives channel the blower-driven air through an elongated, single discharge slot opening in a downwardly or outwardly directed curtain of air.

A common problem with air knives is that the volume and velocity of the discharged air can be limited, which in turn can limit the effectiveness of the air curtain, including its effective transverse width, i.e. the width of the curtain in the direction of travel of objects conveyed through the air curtain. Because blower-operated air knives typically direct an elongated, narrow-width air curtain in a straight downward direction, it is typically not possible to effectively apply the air to objects that have irregular surface heights because the air knife is positioned at a fixed distance above the highest surface of the object. To effectively clean, dry or cool at the lowest heights, more air would have to be delivered to reach the lower surfaces which would increase the operating cost of the system.

To overcome the inherent deficiencies of air knives, individual air nozzles are often used to effectively apply the discharge air to surfaces of varying heights. The superior flow characteristics from a properly designed converging nozzle orifice can deliver the blower-driven air to surfaces at a greater distance than the conventional slot type opening typically used in air knife designs. Air nozzles are frequently attached to pipes and manifolds to replace, or augment, conventional air knives. The typical air nozzle manifold system includes externally attached nozzles secured at fixed positions along a pipe or manifold. Although these external fixed nozzle devices provide superior discharge airflow, they do not allow the user to adjust the air output as can be adjusted with an adjustable air knife slot opening. The dimensions of these fixed external nozzle systems can also vary widely to accommodate the various size and shape external nozzle orifices that are attached. These external nozzle manifold systems can be bulky and cumbersome to install, generally requiring additional space, which may not be available, to accommodate the external nozzles when used to replace an air knife with a slot opening.

Another problem that is characteristic to air knives in general is that they produce significant air turbulence as the air exits the elongated slot opening. This turbulence reduces the velocity of the air exiting the elongated slot opening, which also causes the spray pattern to fan out as it exits the air knife's elongated slot opening. The decreased velocity and fan out pattern of the air both adversely affect the performance and effectiveness of the air knife.

Yet another problem that is characteristic to air knives in general is that they employ an elongated slot opening that is fixed with respect to the actual width of the opening through which air is discharged. While the elongated slot opening may be adjustable with respect to its width, there is limited precision with regard to adjusting this dimension. If the gap is opened too wide, large volumes of air must be utilized to maintain the air velocity as the distance from the objects is increased. Alternatively, the system pressure may have to be increased to maintain the velocity of the air at the discharge. Neither is an acceptable alternative because they both require excessive amounts of energy.

Air knives are generally most effective at close proximity to the surface of the objects to be cleaned, dried, or cooled. Because it is not always possible to achieve the ideal air knife positioning relative to the objects, various workarounds have been utilized in an attempt to solve some of the inherent positioning problems when the physical dimensions of the objects to be dried, cleaned or cooled are changed. Unfortunately, these workaround solutions are typically cumbersome, expensive and difficult to implement, and usually result in operational downtime. None of these workaround solutions satisfactorily address the proper and most effective positioning of the air knife relative to the objects to be cleaned, dried, or cooled.

U.S. Pat. No. 6,742,285 to Shepard discloses an air knife that includes an elongated housing having an inlet for receiving air into the housing. The housing includes an elongated gap that extends along the housing that allows air entering the housing through the inlet to exit the housing and form a curtain of air. The elongated housing is made from a piece of sheet metal bent to define a hollow region into which air is forced. The sheet metal defines a gap along a length of the housing from which the air exits. The elongated air knife forms an angle with respect to a direction of travel of objects passing the air knife so that a leading edge of those objects passes progressively different parts of the air knife. Clearly, this type of air knife design does not permit an easy modification to the air discharge portion of the device and would be most suitable when the objects to be cleaned, dried, or cooled are not expected to have changes in their physical dimensions.

U.S. Pat. No. 6,990,751 to Riley et al discloses an air knife or air delivery manifold that uses tangential thrust nozzles to rotate the air knife or delivery manifold to clean or blow off articles of manufacture or other products. The air knife or air manifold is constructed with laterally separated, opposing ends and mounted for rotation about a longitudinal axis. A central inlet opening defines an axis of rotation. The airflow is emitted through a narrow air discharge slot that is rotated over a circular area by jets of air emitted from the thrust nozzles. These air jets rotate the air knife about a longitudinal axis and in a plane parallel to the direction of conveyor advancement. This patent also discloses an alternative system using external nozzles mounted to an air delivery manifold in specific fixed positions to accommodate the rotational features of the device. This type of rotational air knife design would be most suitable when the objects to be cleaned, dried, or cooled have irregular surface features so that air can be applied from different directions. However, it does not permit an easy modification to the air discharge portion of the air knife or provide maximum efficiency of the air knife with respect to optimization of the discharge nozzles. Nor can it easily accommodate increases in the surface height of the objects to be cleaned, dried or cooled without physically raising the device, which would impact the effectiveness of the device on the lowest surfaces unless more air is discharged from the nozzles.

The devices referenced above provide some desirable features and benefits for air knives within the limited scope of their respective designs. However, each has certain obvious drawbacks, as well. Unfortunately, these air knives are typically designed for use in limited applications and are difficult to modify without incurring significant and costly operational downtime.

From the foregoing, it would be desirable to have an apparatus to directionally discharge air that can be easily modified to provide an optimized air stream to accommodate changes in the physical dimensions or irregular surface features of objects that require drying, cooling or cleaning by passing through the air stream. And it would be extremely desirable to have an apparatus that includes uniquely designed discharge air nozzles in a wide range of orifice sizes, shapes, arrays and spacings without requiring any external configuration changes, or complete change out of the apparatus, while at the same time optimizing the efficiency and operating cost of the overall system operation.

SUMMARY

Disclosed herein is an apparatus that overcomes the deficiencies of conventional air knives. Heretofore, there has not been an apparatus that could be easily modified to optimize a pressurized air stream by directing the pressurized air through interchangeable nozzle inserts with various discharge orifice sizes, shapes and spacings, while at the same time maximizing the efficiency of the apparatus in providing an air stream to dry, cool, or clean objects, and all while minimizing the operational downtime of the system when replacing the interchangeable nozzle inserts.

In accordance with the present invention, the apparatus includes a body designed to optimize a pressurized air stream discharged from the apparatus through the use of interchangeable nozzle inserts designed with various discharge orifice sizes, shapes and spacings, all without the necessity of increasing the air inlet pressure or blower size. The apparatus incorporates at least one interchangeable nozzle insert that is designed as an integral part of the body to ensure a continuous, laminar air stream from the apparatus. The illustrated apparatus is comprised of a body, at least one interchangeable nozzle insert, a blower, and at least one air inlet. The body has opposing sidewalls and two laterally separated ends. Pressurized air is delivered by the blower and enters the body through the air inlet. The pressurized air is discharged from the apparatus through the at least one interchangeable nozzle insert and is directed at objects to be cleaned, dried, or cooled. The at least one interchangeable nozzle insert is comprised of at least one orifice through which the pressurized air stream is directed at the objects to be cleaned, dried or cooled.

Because the objects to be cleaned, dried or cooled will vary from time to time with respect to length, height, configuration, size, and shape, the pressurized air stream delivery required to dry, clean or cool the objects must be adjusted to accommodate the physical changes in the objects. To that end, the apparatus is designed to be easily modified to accommodate these variations in the physical characteristics of the objects by simply replacing the interchangeable nozzle insert with another interchangeable nozzle insert that has different orifice sizes, different orifice spacing, or different orifice configuration. Alternatively, one body design can be replaced by another body design that has different physical dimensions and which may comprise a combination of two or more interchangeable nozzle inserts that have different orifice sizes, different orifice spacings, or different orifice configurations.

The apparatus of the present invention is designed to be easily adaptable to be attached to a suspended support system by means of the at least one external attachment mechanism provided on the top surface of the apparatus or by means of the end external attachment mechanism provided on the first end of the apparatus. The external attachment mechanisms facilitate the easy removal of the apparatus for either replacement with a completely different length body or different sized body, or to simply replace the interchangeable nozzle insert with another interchangeable nozzle insert.

The apparatus of the present invention is configured so that it is not necessary to completely remove the body in order to replace the interchangeable nozzle insert. Because the interchangeable nozzle insert is positioned in the elongated bottom opening of the body by means of the at least one suitable fastener, replacing the interchangeable nozzle insert is simply accomplished by first removing the at least one suitable fastener, removing the interchangeable nozzle insert from the body, inserting another interchangeable nozzle insert into the elongated bottom opening in the body, reinserting the at least one suitable fastener through one of the opposing sidewalls and into and through the corresponding fastener hole on the interchangeable nozzle insert, and securing the at least one suitable fastener to the opposite opposing sidewall.

While the various embodiments of the disclosure are described with reference to an apparatus that can be easily employed to direct pressurized air from a body through one or more interchangeable nozzle inserts to dry, cool, or clean objects that are either stationary or moving transversely through the laminar air stream developed by the apparatus, it is to be understood that there may be combinations of equipment and methods that could be used to clean, cool, or dry objects that employ some features of the disclosure herein. There is no device or apparatus with the disclosed components that is capable of providing a pressurized laminar air stream through interchangeable nozzle inserts with various discharge orifice sizes, shapes and spacings, while at the same time maximizing the efficiency of the apparatus in providing a high velocity, pressurized laminar air stream to dry, cool, or clean objects, and all while minimizing the operational downtime to implement change out of the interchangeable nozzle inserts. Other applications and advantages of such an apparatus will become immediately obvious to one skilled in the art. It is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting. The invention may be described with greater clarity and particularity by reference to the accompanying drawings.

DESCRIPTION

What is being disclosed is an apparatus that may be modified to employ a body style that has been designed to employ a wide range of interchangeable discharge orifice sizes, arrays and spacings to optimize and efficiently deliver a pressurized air stream discharged from the apparatus, while at the same time maximizing the efficiency of the apparatus in providing a high velocity, laminar air stream to dry, cool, or clean objects, and all while minimizing the operational downtime required to implement the modifications to the apparatus. Other advantages and applications will be best understood and become apparent from the following description of the various embodiments when read in connection with the accompanying drawings.

Figure 1:
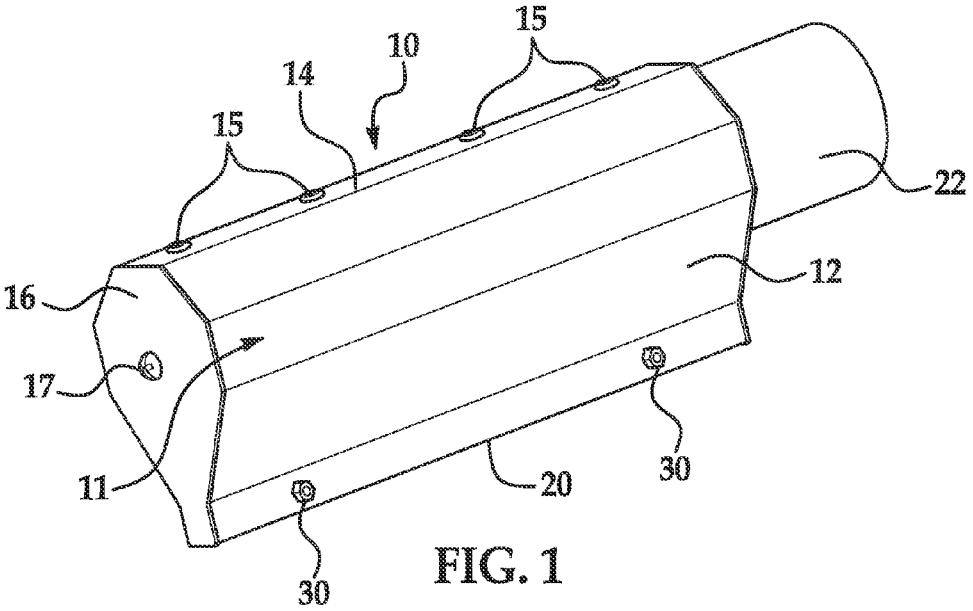
FIG. 1 is a perspective view of one embodiment of the apparatus of the present invention.
Figure 2:
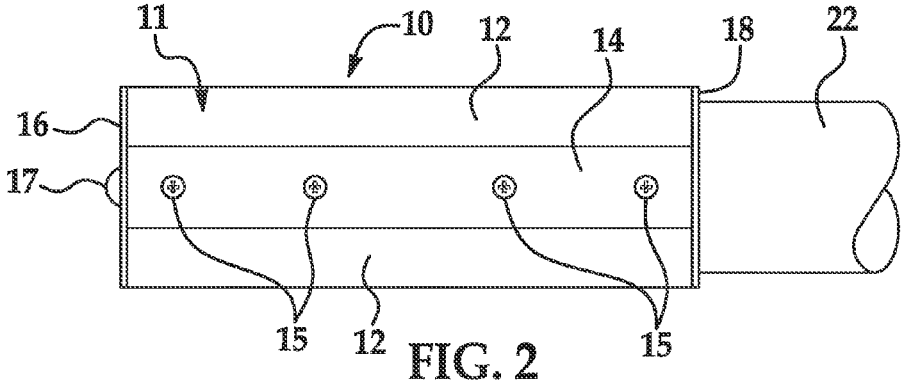
FIG. 2 is a top view of one embodiment of the apparatus of the present invention.
Figure 3:
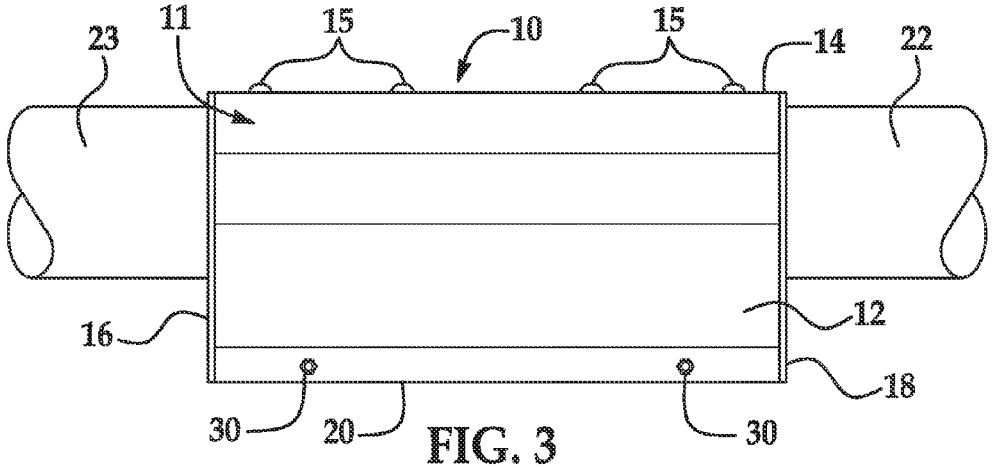
FIG. 3 is a side view of one embodiment of the apparatus of the present invention.

Referring now more particularly to FIGS. 1, 2 and 3, the apparatus 10 is shown here in the preferred embodiment of the present invention. In the preferred embodiment, the apparatus 10 is comprised of a body 11 formed by joining opposing sidewalls 12 that, when connected to each other, form a top surface 14. The opposing sidewalls 12 are connected to a first end 16 and a second end 18. In the preferred embodiment, the body 11 has an elongated teardrop configuration formed by the general teardrop configuration of the first end 16 and the second end 18. There is an elongated bottom opening 20 that is formed by the attachment of the opposing sidewalls 12 to the first end 16 and the second end 18. There is also shown an at least one air inlet 22 that is suitably attached to the second end 18. The blower (not shown) provides a source of pressurized air that enters the apparatus 10 via the at least one air inlet 22. Depending on the relative configuration and location of the blower (not shown) and its associated piping, or other physical constraints, it should be obvious to one skilled in the art that the apparatus 10 can be rotated 180° along its horizontal axis to allow the at least one air inlet 22 to be positioned on either the right side or the left side of the apparatus 10.

In one alternative embodiment of the present invention, the body 11 is formed as a single element by using suitable metal or plastic materials and employing a bending process or an extrusion process to form the body 11. In this alternative embodiment of the present invention the body 11 is formed as a single element with the physical characteristics of opposing sidewalls 12, a top surface 14, a first end 16, a second end 18, and an elongated bottom opening 20. The body 11 is preferably formed to maintain an elongated teardrop configuration of the body 11 to force the pressurized air entering the apparatus 10 downward to increase the velocity of the pressurized air as it approaches the elongated bottom opening 20.

With continued reference to FIGS. 1, 2 and 3, there is shown an at least one air inlet 22 to allow pressurized air from a blower (not shown) to be delivered to the apparatus 10. In the preferred embodiment, the pressurized air enters the apparatus 10 through the at least one air inlet 22 that is suitably attached to the second end 18. The pressurized air is directed downward within the apparatus 10 following the sloping opposing sidewalls 12. The general teardrop configuration of the body 11 forces the pressurized air downward which increases the velocity of the pressurized air as it approaches the elongated bottom opening 20.

The body 11 may be fabricated in a variety of different widths and lengths to accommodate the combination of external equipment, physical constraints, and air flow requirements that are needed to effectively clean, cool, or dry objects. With specific reference to FIG. 3, one alternative embodiment of the present invention has an air inlet 23 on the first end 16 and an air inlet 22 on the second end 18 of the apparatus 10 in order to attain the proper volume and flow rate of air within the apparatus 10 to effectively clean, cool, or dry objects. In yet another alternative embodiment of the present invention, the apparatus 10 has an at least one air inlet 22 located at or near the horizontal midpoint on the top surface 14 in order to attain the proper volume and distribution of air within the apparatus 10 to effectively clean, cool, or dry objects.

With continued reference to FIGS. 1, 2 and 3, there is shown at least one top external attachment mechanism 15 on the top surface 14. In a preferred embodiment, there are four top external attachment mechanisms 15. The at least one top external attachment mechanism 15 is used to attach the apparatus 10 to any suitable external support or suspension device (not shown) to allow the apparatus 10 to be suspended and positioned appropriately above the objects that are to be dried, cooled, or cleaned by application of the apparatus 10. There is also disclosed an end external attachment mechanism 17 that can be used to attach the apparatus 10 to any suitable external support or suspension device (not shown) to allow the apparatus 10 to be suspended and positioned appropriately above the objects that are to be dried, cooled, or cleaned by application of the apparatus 10. It should be noted that the at least one top external attachment mechanism 15 and the end external attachment mechanism 17 can be used separately or in combination with each other.

Figure 4:
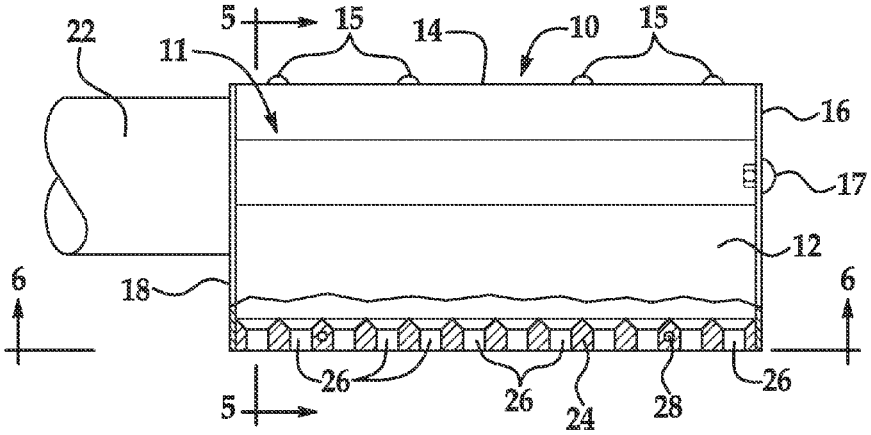
FIG. 4 is a side view with a partial cut away of the apparatus for one embodiment of the present invention.

Referring specifically to FIG. 4, and also to FIG. 1 as appropriate, there is shown a side view of the apparatus 10 with a partial cut away showing the at least one interchangeable nozzle insert 24 positioned within the elongated bottom opening 20, the elongated bottom opening formed by the attachment of the opposing side walls 12 to the first end 16 and the second end 18. The at least one nozzle insert 24 is comprised of at least one discharge orifice 26 tooled through the top surface of the at least one interchangeable nozzle insert 24. There is at least one fastener hole 28 tooled completely through the side of the interchangeable nozzle insert 24. In the preferred embodiment of the present invention, the at least one discharge orifice 26 is comprised of multiple discharge orifices 26 tooled into and suitably spaced and positioned on the interchangeable nozzle insert 24. The diameter of the at least one discharge orifices 26, and the spacing and positioning of the at least one discharge orifices 26 will be determined by the pressurized air flow characteristics required to be directed at, or impinging on, the objects to be cleaned, dried, or cooled.

With continued reference to FIG. 4, in the preferred embodiment of the present invention the at least one discharge orifice 26 is tooled vertically into the at least one nozzle insert 24 to provide an optimized pressurized air stream that is directed vertically downward from the apparatus 10. To obtain an air stream directed other than vertically downward for the pressurized air being discharged from the apparatus 10, one need simply rotate the apparatus 10 to the desired angle by adjusting the external support mechanism (not shown) to achieve the desired angular air stream direction. In an alternative embodiment of the present invention, the at least one discharge orifice 26 is tooled at a desired angle into the at least one nozzle insert 24 to provide an optimized air stream of pressurized air at the desired angle as it is discharged from the apparatus 10. In yet another embodiment of the present invention, the at least one discharge orifice 26 is comprised of multiple discharge orifices 26 that are tooled into the interchangeable nozzle insert 24 in any combination of discharge orifices 26 that are tooled vertically or at any desired angle to obtain the pressurized air flow characteristics and optimized air stream required to be directed at the objects to be cleaned, dried, or cooled.

Figure 5:
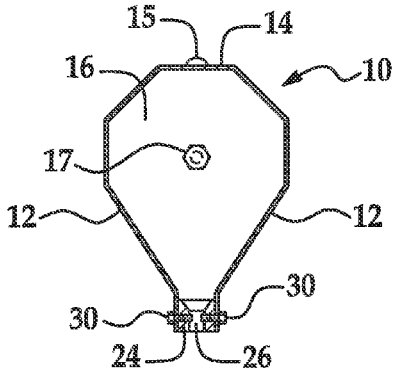
FIG. 5 is a section view of the apparatus for one embodiment of the present invention taken in the plane of line 5-5 in FIG. 4.

With reference to FIG. 5, there is shown a section view of the apparatus 10 for one embodiment of the present invention taken in the plane of line 5-5 in FIG. 4. This view of one embodiment of the present invention allows one skilled in the art to appreciate the affect of the elongated teardrop configuration of the body 11 formed by joining the first end 16, the opposing sidewalls 12, and the second end 18. As the pressurized air is delivered from the blower (not shown) through the air inlet 22 into the apparatus 10, the velocity of the pressurized air is increased as it converges and is forced down the sloping sides of the opposing sidewalls 12 and exits through the at least one discharge orifice 26 that is tooled into the at least one interchangeable nozzle insert 24.

Figure 6:
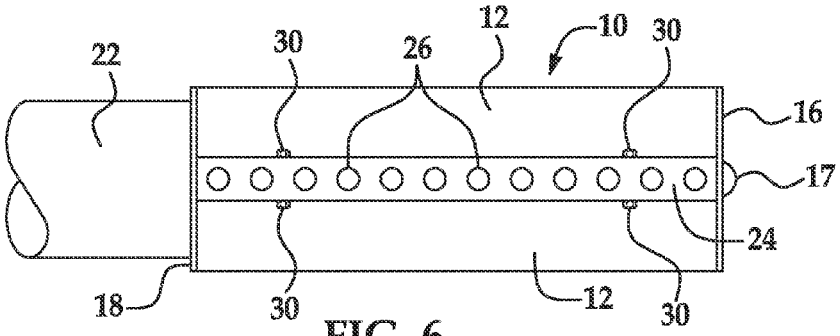
FIG. 6 is a bottom view of the apparatus for one embodiment of the present invention taken in the plane of line 6-6 in FIG. 4.

With reference to FIG. 6, and also to FIG. 1 as appropriate, there is shown a bottom view of the apparatus 10 for one embodiment of the present invention taken in the plane of line 6-6 in FIG. 4. This preferred embodiment of the present invention discloses the at least one interchangeable nozzle insert 24 positioned within the elongated bottom opening 20 of the apparatus 10. The interchangeable nozzle insert 24 is maintained within the elongated bottom opening 20 of the apparatus 10 by means of at least one suitable fastener 30. The at least one suitable fastener 30 is first passed through one of the opposing sidewalls 12 and into and through the at least one fastener hole 28 located on the at least one nozzle insert 24 and then secured to the other opposing sidewall 12. In the preferred embodiment of the present invention, the at least one suitable fastener 30 is comprised of a bolt and nut combination.

Figure 7:
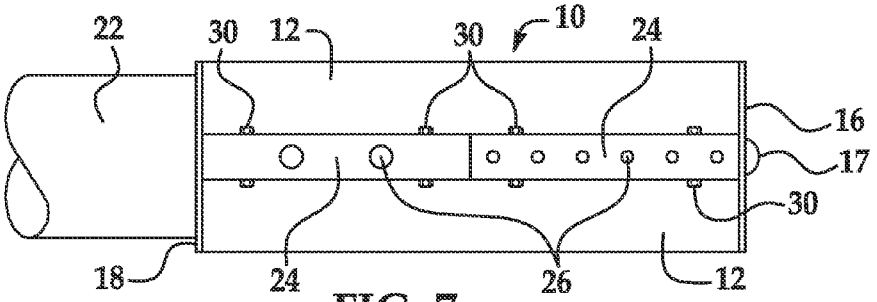
FIG. 7 is a bottom view of the apparatus for an alternative embodiment of the present invention.
Figure 8:
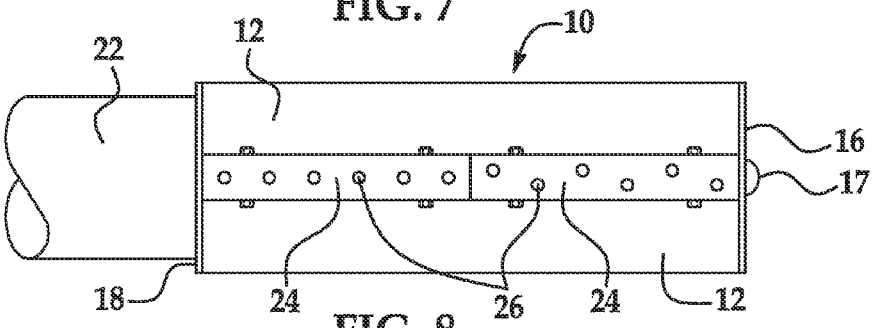
FIG. 8 is a bottom view of the apparatus for yet another alternative embodiment of the present invention.

With reference to FIG. 7 and FIG. 8, and also to FIG. 1 as appropriate, there is shown a bottom view of the apparatus 10 for two alternative embodiments of the present invention. These alternative embodiments of the present invention disclose two interchangeable nozzle inserts 24 positioned within the elongated bottom opening 20 of the body 11. The interchangeable nozzle inserts 24 are maintained within the elongated bottom opening 20 of the body 11 by means of four suitable fasteners 30. The fasteners 30 are first passed through one of the opposing sidewalls 12 and into and through the corresponding fastener hole 28 located on the respective interchangeable nozzle insert 24 and then secured to the other opposing sidewall 12. These alternative embodiments also disclose differing orifice 26 sizes, spacings, and locations with respect to the two interchangeable nozzle inserts 24 shown on the respective alternative embodiments disclosed in FIG. 7 and FIG. 8.

Figure 9:
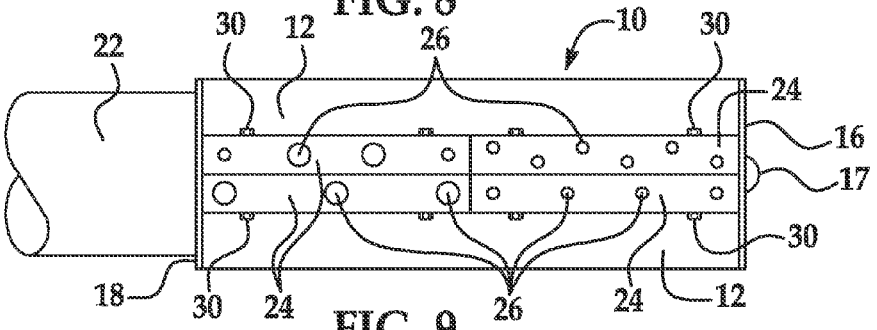
FIG. 9 is a bottom view of the apparatus for still another alternative embodiment of the present invention.

With reference to FIG. 9, and also to FIG. 1 as appropriate, there is shown a bottom view of the apparatus 10 for still another alternative embodiment of the present invention. This alternative embodiment of the present invention discloses four interchangeable nozzle inserts 24 positioned within the elongated bottom opening 20 of the body 11. The interchangeable nozzle inserts 24 are maintained within the elongated bottom opening 20 of the body 11 by means of four suitable fasteners 30. The fasteners 30 are first passed through one of the opposing sidewalls 12 and into and through the corresponding fastener holes 28 located on the respective interchangeable nozzle inserts 24 and then secured to the opposite opposing sidewall 12. This alternative embodiment also discloses differing orifice 26 sizes, spacings, and locations with respect to the four interchangeable nozzle inserts 24 shown. The placement of four interchangeable nozzle inserts 24 within the elongated bottom opening 20 of the body 11 necessarily requires a wider elongated bottom opening 20 to accommodate the four interchangeable nozzle inserts 24 when positioned as shown in FIG. 9. The wider opening of the elongated bottom opening 20 is formed by appropriate fabrication changes made to the dimensions of the first end 16 and the second end 18 because the elongated bottom opening 20 is formed by the attachment of the opposing side walls 12 with the first end 16 and the second end 18.

Figure 10:
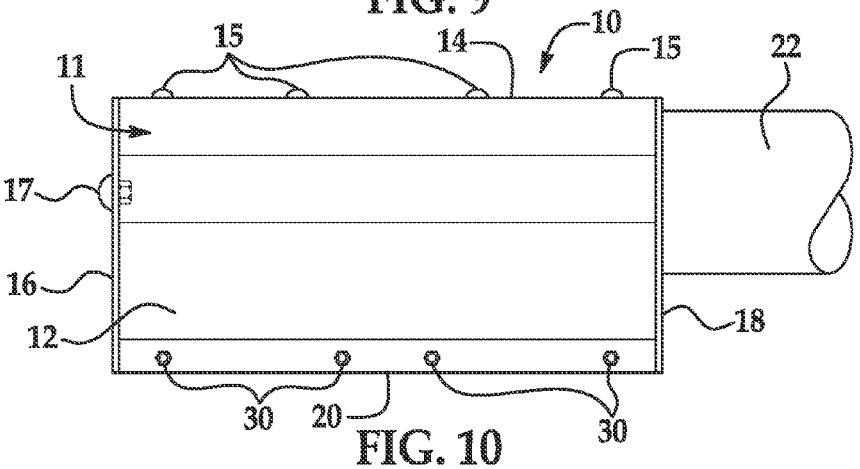
FIG. 10 is a side view of the apparatus for the alternative embodiments of the present invention shown in FIGS. 7, 8, and 9.

With reference to FIG. 10, and also to FIG. 1 as appropriate, there is shown a side view of the apparatus 10 for the alternative embodiments of the present invention disclosed in FIGS. 7, 8, and 9. The placement of more than one interchangeable nozzle insert 24 within the elongated bottom opening 20 of the body 11 in an end-to-end configuration requires four suitable fasteners 30, which will be secured on the opposite side opposing sidewall 12, to maintain the interchangeable nozzle inserts 24 in proper position within the elongated bottom opening 20.

The foregoing descriptions provide illustration of the inventive concepts. It should be understood that the foregoing is illustrative of particular embodiments of the invention, and particular applications thereof. The descriptions are not intended to be exhaustive or to limit the disclosed invention to the precise form disclosed. Modifications or variations are also possible in light of the above teachings. In view of the disclosures presented herein, yet other variations of the invention being disclosed will be apparent to one of skill in the art. The embodiments described above were chosen to provide the best application to thereby enable one of ordinary skill in the art to utilize the invention in various embodiments and with various modifications as are suited to the particular use contemplated. All such modifications and variations are within the scope of the invention. Any such modifications or variations which fall within the purview of the descriptions contained herein are intended to be included therein, as well. It is the following claims, including all equivalents, which define the scope of the invention.

What is claimed is:

1. An apparatus for directing pressurized air comprising:

a body for receiving pressurized air, the body including opposing side walls, a top surface joining the opposing side walls, a first end joining the top surface and the opposing side walls, a second end joining the top surface and the opposing side walls, and a bottom opening defining an elongated shape bounded by the opposing side walls, the first end and the second end, where the opposing side walls converge toward the bottom opening at a predetermined angle of convergence;

at least one interchangeable nozzle insert configured to match the elongated shape of the bottom opening, the at least one interchangeable nozzle insert positioned within the bottom opening by means of at least one fastener which passes through the at least one interchangeable nozzle insert and the opposing side walls, where the pressurized air can exit the body substantially only through the at least one interchangeable nozzle insert, where the at least one interchangeable nozzle insert includes a plurality of discharge orifices for directing the pressurized air outwardly from the body, and where each of the discharge orifices includes a conical portion for receiving the pressurized air from the body, each of the conical portions having an opening angle which is substantially the same as the angle of convergence of the opposing side walls, and each of the discharge orifices further includes a cylindrical portion for directing the pressurized air outwardly from the body;

at least one air inlet, the at least one air inlet suitably attached to the body for directing the pressurized air into the body; and a blower for supplying the pressurized air into the body through the at least one air inlet.

2. The apparatus of claim 1 wherein the plurality of discharge orifices have the same diameter.

3. The apparatus of claim 1 wherein the plurality of discharge orifices have different diameters.

4. The apparatus of claim 1 wherein the plurality of discharge orifices discharge the pressurized air in a direction which is perpendicular to the bottom opening.

5. The apparatus of claim 1 wherein the plurality of discharge orifices discharge the pressurized air at a non-perpendicular angle relative to the bottom opening.

6. The apparatus of claim 1 wherein the at least one air inlet comprises two air inlets, the first air inlet suitably attached to the first end and the second air inlet suitably attached to the second end.

7. The apparatus of claim 1 wherein the at least one interchangeable nozzle insert comprises two or more nozzle inserts with different orifice patterns.

8. An apparatus for directing pressurized air comprising:

a body for receiving pressurized air, the body including opposing side walls, a top surface joining the opposing side walls, a first end joining the top surface and the opposing side walls, a second end joining the top surface and the opposing side walls, and a bottom opening defining an elongated shape bounded by the opposing side walls, the first end and the second end, where the opposing side walls converge toward the bottom opening at a predetermined angle of convergence;

at least one interchangeable nozzle insert configured to match the elongated shape of the bottom opening, the at least one interchangeable nozzle insert positioned within the bottom opening by means of at least one fastener which passes through the at least one interchangeable nozzle insert and the opposing side walls, where the pressurized air can exit the body substantially only through the at least one interchangeable nozzle insert, where the at least one interchangeable nozzle insert includes a plurality of discharge orifices for directing the pressurized air outwardly from the body, and where each of the discharge orifices includes a conical portion for receiving the pressurized air from the body, each of the conical portions having an opening angle which is substantially the same as the angle of convergence of the opposing side walls, and each of the discharge orifices further includes a cylindrical portion for directing the pressurized air outwardly from the body; and at least one air inlet, the air inlet suitably attached perpendicular to the body at a location between the first end and the second end for directing the pressurized air into the body.

9. The apparatus of claim 8 wherein the plurality of discharge orifices have the same diameter.

10. The apparatus of claim 8 wherein the plurality of discharge orifices have different diameters.

11. The apparatus of claim 8 wherein the plurality of discharge orifices discharge the pressurized air in a direction which is perpendicular to the bottom opening.

12. The apparatus of claim 8 wherein the plurality of discharge orifices discharge the pressurized air at a non-perpendicular angle relative to the bottom opening.

13. The apparatus of claim 8 further comprising a blower for supplying the pressurized air into the body through the air inlet.

14. The apparatus of claim 8 wherein the at least one interchangeable nozzle insert comprises two or more nozzle inserts with different orifice patterns.

* * * * *